United States Patent [19]

Willmann

[11] Patent Number: 4,520,733

[45] Date of Patent: Jun. 4, 1985

[54] GUIDE RAIL AND FOLLOWER WHEEL CONSTRUCTION FOR MONORAIL

[75] Inventor: Claude Willmann, Morschwiller-le-Bas, France

[73] Assignee: Societe Anonyme Dite: Establissements Tourtellier S.A., France

[21] Appl. No.: 392,755

[22] Filed: Jun. 28, 1982

[30] Foreign Application Priority Data

Jul. 1, 1981 [FR] France ..... 81 13072

[51] Int. Cl.[3] ..... B61B 3/02; E01B 25/22

[52] U.S. Cl. ..... 104/93; 104/110; 104/162; 104/165; 105/150; 105/153; 191/32; 238/244; 238/246; 295/9 R; 295/33

[58] Field of Search ..... 104/93, 106, 110, 118–120, 104/162, 165, 172 S; 105/148, 150, 153; 191/32, 29 R; 295/9 R, 33; 238/244, 246

[56] References Cited

U.S. PATENT DOCUMENTS

| | | | |
|---|---|---|---|
| 3,013,499 | 12/1961 | Hubert | 104/165 X |
| 3,045,808 | 7/1962 | Blanc | 104/172 S X |
| 3,327,644 | 6/1967 | Black | 104/106 |
| 3,407,750 | 10/1968 | Rantz | 104/162 |
| 3,411,456 | 11/1968 | Stevens | 104/172 S X |
| 3,625,158 | 12/1971 | Lorenz et al. | 104/93 |
| 3,850,270 | 11/1974 | Hillmann | 191/29 R |
| 3,902,579 | 9/1975 | Howell, Jr. | 191/29 R |
| 4,393,785 | 7/1983 | Hortnagel | 104/93 X |

FOREIGN PATENT DOCUMENTS

| | | | |
|---|---|---|---|
| 347409 | 4/1931 | United Kingdom | 104/93 |
| 576874 | 4/1946 | United Kingdom | 295/9 R |
| 877964 | 9/1961 | United Kingdom | 104/119 |
| 2099386 | 12/1982 | United Kingdom | 191/32 |

*Primary Examiner*—Randolph Reese

*Attorney, Agent, or Firm*—Darby & Darby

[57] ABSTRACT

A guide rail and follower wheel construction for a monorail are disclosed. The monorail vehicle follower wheel has a radially directed, circumferential groove shaped to fit over a raised track portion, and the cross sectional shape of the wheel groove and the track over which it fits are such that the uppermost portion of the track contacts the radially innermost portion of the wheel groove. The wheel is mounted on the system comprising: a shaft and wheel includes opposed side-plates mounted for rotation on the shaft and a center disc mounted on the shaft between the side-plates and having a diameter less than that of the side-plates so as to form the groove. The side-plates are shaped to taper in diameter towards the center disc so that the uppermost track portion contacts only the disc. The side plates are rotatable on the shaft independently of the disc. On sloping sections of the guide rail, the uppermost portion of the rail is truncated, so that side walls of the wheel groove and opposing side walls of the rail engage thereby increasing the frictional contact between them to improve the vehicle's traction on grades. The guide rail also incorporates an arrangement of notches and grooves on a center web to permit ready attachment of insulators, and upper and lower opposed grooves are provided for mounting fish plates. The fish plates are made adjustable in height by providing diagonally abutted edges and sliding abutted plates relative to each other prior to securement.

12 Claims, 10 Drawing Figures

VI
VIII
10
4
11
88
89
106
107
108
126
127
128
129
130
131
132
133
134
135
136
137
138
139
140
141
142
143
144
145
146
82
83
84

GUIDE RAIL AND FOLLOWER WHEEL CONSTRUCTION FOR MONORAIL

The present invention pertains to a system for transporting loads and, more specifically, to an overhead monorail system consisting of: one one hand, a series of guide rails containing horizontal and sloping sections, with each guide rail being formed by an angle bar with a vertical center web, so as to provide support for at least one track; and, on the other hand, a set of trolleys and/or self-propelling bogies from which the loads which are to be transported shall be hung.

Belgian Pat. No. 743,833 provides a description of a monorail system which includes trolleys consisting of a drive mechanism designed to provide traction and an undercarriage connected thereto. The drive mechanism consists of a gear-box in the form of a U-shaped linkage, with a single vertical travelling and supporting wheel being mounted within the upper arm thereof in a position permitting turning. By means of an endless screw mechanism, the axle of said wheel is driven by a motor which occupies a perpendicular position in relation to the axle. The aforementioned wheel possesses a circumferential groove which fits upon the uppermost portion of the guide rail, and the guide rail consists of two tubular angle bars, with one angle bar situated above the other and with the angle bars being connected to one another by means of an intervening vertical web.

In addition, French Pat. No. 2,387,149 provides a description of a system for transporting loads which specifically consists of: on one hand, an overhead track possessing a guide rail with straight and curved sections, junctions, and crossings, wherein the upper and lower tracks are connected to one another by means of a vertical center web; and, on the other hand, self-propelling trolleys which possess centering and steering devices and are outfitted with brushes which provide contact with electric power lines. Both the upper and lower tracks possess vertical shoulders on both sides, and these shoulders extend parallel to the vertical center webs. Hence, this type of guide rail possesses two lengthwise hollow sections which are demarcated by the vertical center web on one side and by two vertical shoulders situated within the same vertical plane, on the other side. These lengthwise hollow sections serve as compartments for various items, such as electric power cables, telephones cables, compressed air pipes, end of stroke attachments, pivots, control cams for the end of stroke attachments, et cetera. The vertical shoulders situated on a given side are outfitted with clamping arrangements which ensure attachment of guide rails to supporting girders, in order to permit fastening of the guide rails to a metal framework, or the shoulders are outfitted with clips which link the guide rails to supporting girders for electric power lines which supply electric power for motors installed on the self-propelling trolleys and/or bogies.

Nevertheless, previously developed types of guide rails are produced by means of bending procedures, and they therefore contain uneven portions, especially in a lengthwise direction, whereby only an extremely limited upward slope, of approximately five degrees, is possible. If a steeper slope is provided, there is a risk that the trolleys and/or bogies may slide backward and/or slip, and it is not possible to ensure upward movement solely by adhesion of the wheels to the upper track of the guide rail.

The purpose of the present invention is to furnish a means of transporting loads which is usable in the form of an overhead monorail, a double overhead rail, or a ground-level monorail mounted on studs or situated directly upon the ground, with either one-way or two-way tracks, as well as other possible applications. As a result of adhesion of one or more wheels on the trolleys and/or self-propelling bogies to the upper track of the guide rail, it is possible for these trolleys and/or self-propelling bogies to travel up slopes which are considerably steeper than allowable slopes for prior types of monorails. Hence, an incline of as much as thirty degrees is possible with a live load of one hundred and fifty kilograms, or forty-five degrees with a live load of one hundred kilograms, or even sixty degrees with a live load of fifty kilograms.

Hence, the present invention pertains to a system for transporting loads, notably an overhead monorail system consisting of: on one hand, a series of guide rails with horizontal and sloping sections, with each guide rail consisting of an angle bar with a vertical center web which supports at least one track situated above; and, on the other hand, a set of trolleys and/or self-propelling bogies from which the loads which are to be transported shall be hung. This system is characterized by the fact that the guide rail is formed by an upper tubular angle bar which is connected by a vertical center web to a perfectly gauged lower angle bar, which is flat and is composed of an extruded material, namely aluminum. The flat angle bar and the vertical center web are outfitted with attachments and catches for insulating angle bars, which contain electric power lines, and the upper tubular angle bar possesses a center surface adapted to the bottom portion of the groove located on the wheel or wheels intended for horizontal movement, as well as a double side seating adapted to the sides of the groove located on the wheel or wheels for upward movement of the trolleys and/or self-propelling bogies.

The present invention can be more fully understood by means of the following description, which is provided in terms of a non-restrictive example of said invention, and in relation to the accompanying illustrations, among which:

Figure 1:
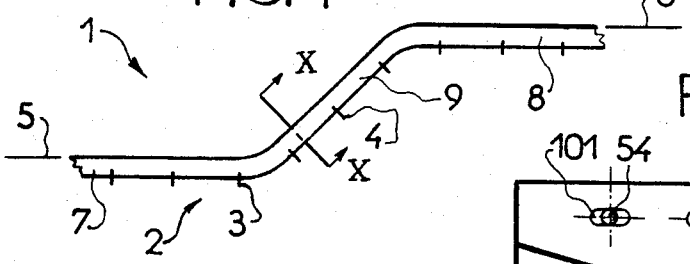
FIG. 1 is a diagrammatic view of a segment of a guide rail system containing an ascending section.

In terms of FIG. 1, the system for transporting loads (1) includes a series of guide rails (2), which permit movement of trolleys and/or self-propelling bogies (3,4). In many instances, the system (1) must transfer loads from a lower level (5) to an upper level (6), and, for this purpose, it is necessary to place between the lower horizontal section (7) and the upper horizontal section (8) of the guide rail (2) an inclined section (9), with a slope which can vary between thirty and sixty degrees in relation to the horizontal line, for loads from one hundred and fifty to fifty kilograms.

Nevertheless, in order to permit the trolleys and/or self-propelling bogies (3,4) to travel upward automatically, solely by means of adhesion, it is necessary to provide means of increasing adhesion between the wheel or wheels (10) on said trolleys and/or self-propelling bogies and or the guide rail (2), at the location for the inclined section (9).

Figure 3:
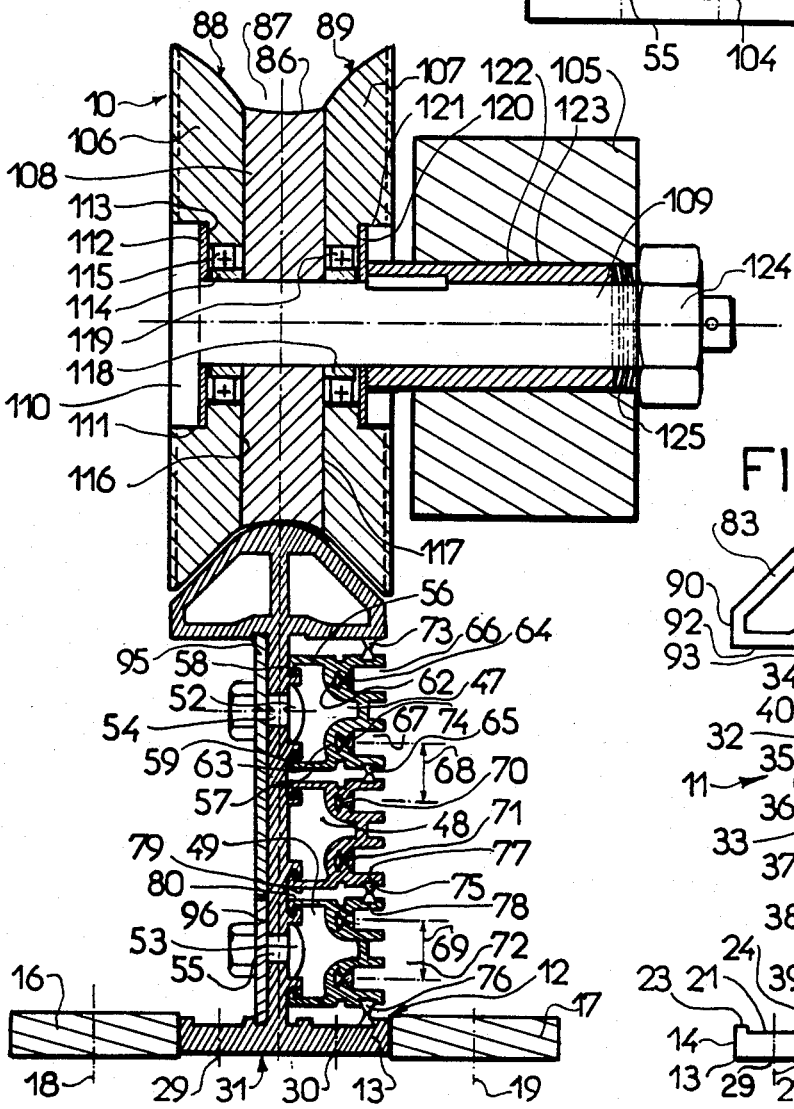
FIG. 3 is an overhead sectional view of a guide rail in contact with the wheel of a trolley or a self-propelling bogie.
Figure 2:
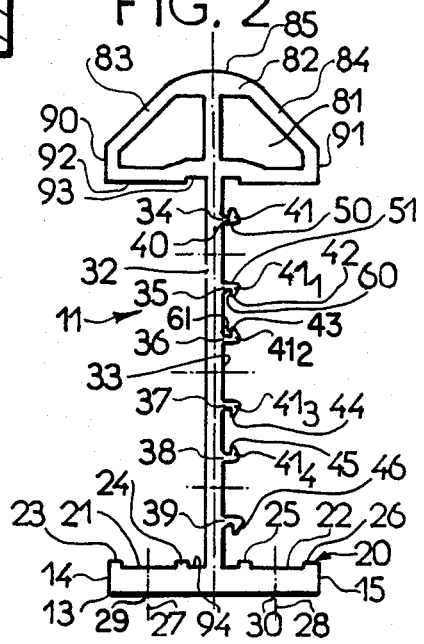
FIG. 2 is an overhead view of an extruded angle bar constituting a guide rail.

In relation to FIGS. 2 and 3, the guide rail (2) in accordance with the present invention consists of an angle bar composed of an extruded material, notably aluminum. Because this angle bar has been produced from an extruded material, it is prefectly gauged. Moreover, on account of the material which is used, the weight of the guide rail (2) is considerably less, whereby it can permit transporting of loads between five and two hundred and fifty kilograms with one motor assembly, or five hundred kilograms with an additional motor. In many instances, handling systems are exposed to humid environments, but the aluminum guide rail is not affected by such conditions.

A lower flat angle bar (13) with parallel, vertical edges (14,15) is attached to the lower portion of the previously cited angle bar (11). These edges (14,15) constitute tracks for the guide wheels (16,17) on trolleys and/or bogies (3,4), turning around a vertical axis (18,19). The upper surface (20) of the flat angle bar in a lower position (13) contains two lengthwise grooves (21,22), which have permitted formation of two parallel sets of shoulders, (23,24) and (25,26). These shoulders (23–26) can function as stops for the top portions of fastening components, such as bolts. Consequently, by drilling holes in the lower flat angle bar (13) according to the axes identified as (27,28), it is possible to place the angle bar identified as (11) upon studs, poles, or other supporting members. When the bolt is turned downward, it is possible to eliminate any turning of the screw, with the screw head being held in place by the previously cited shoulders (23,24,25, and 26). In order to facilitate positioning of the holes drilled from the bottom upward, two lengthwise incisions (29,30) are cut in the bottom surface (31) of the lower flat angle bar (13), and these incisions (29,30) are situated within the same vertical plane as the axes identified as (27 and 28).

The angle bar identified as (11) also possesses a vertical center web (32). One face (33) of the vertical center web (32) contains a catch arrangement (34,35,36,37,38,39). The aforementioned catch arrangement (34–39) is joined to the vertical center web (32) as a result of extrusion of the angle bar (11), and it consists of plates whereby one side (40) is horizontal and is attached to the face of the web (33), while another side (41) is vertical and is therefore parallel to the face of the web (33). The edges (42,43, 44, and 45) of the two vertical sides constitute faces ($41_1$,$41_2$ and $41_3$,$41_4$) which possess sloping portions (46) intended to facilitate attachment of angle bars composed of an insulating material (47,48, 49). On the other hand, the outer faces (50,51) of the horizontal sides (40) extend horizontally, thereby furnishing shoulders which can function as stops for the top portions (52,53) of fastening components (54,55).

The angle bars composed of insulating materials (47,48, 49) contain two claws (56,57) whose unattached ends possess bent portions (58,59) which are fastened to the inner surfaces (60,61) of the vertical sides (41) of the catch components (34–39). Installation of the aforementioned angle bars (47–49) is facilitated by the sloping portions (46), which allow separation of the claws (56,57). The claws return to a resting position when the bends (58,59) are engaged with the vertical sides (41). These angle bars composed of insulating materials (47–49) contain two holes (62,63) for insertion of electric power lines (64,65). Inasmuch as each angle bar (47–49) can accomodate two electric power lines (64,65), these can be two-pole lines. The aforementioned holes (62,63) contain grooves (66,67) at both ends, in order to permit placement of brushes for the trolleys and/or self-propelling bogies (3,4).

In order to obtain secure positioning of the center-to-center portions (68,69) of the aforementioned electric power lines (65,70 or 71,72), biconical struts (73,74,75,76) which are secured within dovetailed grooves (77,78) cut within the outer surfaces (79,80) of the previously mentioned claws (56,57) are placed between the two angle bars composed of insulating materials (47,48 or 48,49), or between the outer angle bars (47,49) and the guide rail (2). On account of this particular structural arrangement, the different components, namely the angle bar identified as (11), the angle bars composed of insulating materials (47,48,49), the electric power lines (63,70,71,72), and the biconical struts (73–76) can shift in relation to one another, while retaining their own respective expansivity. Therefore, expansion of any component is independent from expansion of other components, and it is possible to prevent loss of shape as a result of differences in expansivity.

The upper end of the angle bar identified as (11) possesses an upper tubular portion (81) which constitutes a track upon which the wheel (10) can roll. This upper tubular portion (81) consists of a center surface (82), which extends in the form of two side surfaces (83,84) situated on either side of said center surface (82). The center surface contains a cambered surface portion (85) which fits against the bottom portion (86) of the groove (87) within the wheel (10), when the trolleys and/or self-propelled bogies (3,4) travel along horizontal paths. There is a slight clearance between the two side surfaces (83,84) and the sides (88,89) of the groove (87), so that only the bottom portion (86) of the groove (87) on the wheel (10) is in contact with the rolling track (81). The side-portions (88,89) possess convex surfaces which function as a guide when the trolleys and/or bogies (3,4) move in a horizontal direction. At the location for an inclined rail section (9), the center surface (82) is planed so that the convex sides (88,89) of the groove (87) shall be in contact with the two side surfaces (83,84). On account of the particular shape of the sides (88,89), one obtains a corner configuration, which increases adhesion and permits the aforementioned trolleys and/or bogies (3,4) to travel upward. The two side surfaces (83,84) extend onto two parallel vertical flanks (90,91), which provide additional lateral guidance.

In addition, the lower surfaces (92) of the upper tubular angle bar (81) and the upper surfaces (20) of the lower flat angle bar (13) contain grooves (93,94) into which fish-plates (95,96) are inserted. These fish-plates (95,96) are intended to ensure assembly of the various lengths of the guide-rail (2). Indeed, the angle bars identified as (11) possess a specific length, and it is necessary to place these angle bars (11) end-to-end in order to obtain the desired length for the guide rail.

Figure 4:
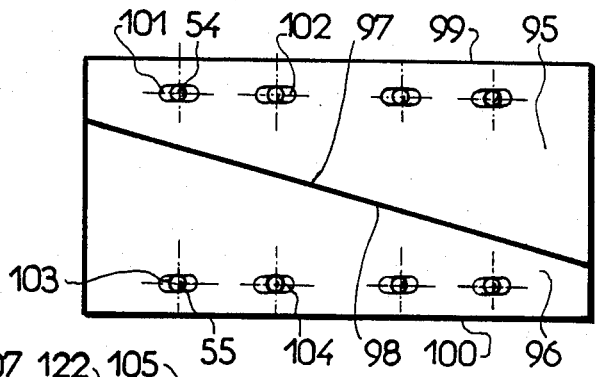
FIG. 4 is an overhead view of fish-plates used to connect two angle-bar sections.

In relation to FIGS. 3 and 4, the aforementioned fish-plates (95,96) are placed in contact by means of edges (97,98) which slant in opposite directions from one another. Therefore, when a slanting edge (97) on one fish-plate (95) slides onto the slanting edge (98) of the other fish-plate (96), the outer lengthwise edges (99,100) are drawn toward one another or away from one another, permitting adjustment of the pressure applied by the fish-plates (95,96) upon two sections of the angle bar (11), in order to provide a guide rail (2) possessing the desired length. In order to permit sliding of one fish-plate (95) in relation to the other (96), the aforementioned fish-plates (95,96) contain horizontal openings (101,102,103,104 . . . ) for insertion of means of attachment (54,55), which ensure connection of the fish-plates (95,96) to the angle bar.

In certain instances, for example in atmospheres containing explosive substances, in painting cabins, or in facilities where immersion in acid baths takes place, it is not possible to use electric power lines. Consequently, it is necessary to provide a release mechanism for the wheel (10) and the power-reduction assembly (105) for trolleys and/or bogies (3,4). Accordingly, as can be observed within FIG. 3, the wheel (10) can be composed of three components which are capable of moving sideways, namely two side-plates (106,107) which are separated by a center disc (108), with these three components being mounted upon the shaft (109) for the power-reduction assembly (105). The center disc (108) possesses a smaller diameter than the two side-plates (106,107), in order to furnish contact with the groove (87).

The end (110) of the shaft (109) is enclosed within a housing (111) situated within one of the side-plates (106), and this end of the shaft is supported by a brake disc (112) which, in turn, rests upon the bottom portion (113) of the aforementioned housing (111). A socket (114) within which a ball bearing (115) is mounted rests against the brake disc (112) mounted upon the shaft (109). This socket (114) also serves as a cross-piece between the brake disc (112) and one of the surfaces (116) of the center disc (108). In a similar manner, another socket (118) wherein another ball bearing (119) is mounted rests against the opposite surface (117) of the same center disc (108). This second socket (118) constitutes a cross-piece between the second surface (117) of the center disc (108) and another brake disc (120) situated within a housing (121) located upon the opposite side-plate (107). A sliding hub (122) mounted upon the shaft (109) rests against the second brake disc (120), and this hub is capable of turning inside a hole (123) bored within the power-reduction assembly. A flexible component (125) consisting of several flexible washers is positioned between a locking device (124) and the sliding hub (122).

When the component identified as (124) is locked, the two side-plates (106,107) are strongly pressed against the center disc (108), and, as a result, the three components identified as (106,107, and 108) form a single element, with the wheel (10) being turned by the shaft (109).

When the component identified as (124) is disengaged, the three components identified as (106,107, and 108) separate, and the center disc (108) is able to rotate freely around the stationary shaft (109), while the wheel (10), and, as a result, the trolleys and/or the bogies (3,4) can be operated by means of a push-rod (126), which constitutes an auxiliary drive component.

Figures 5, 6, 7, 8, 9, 10:
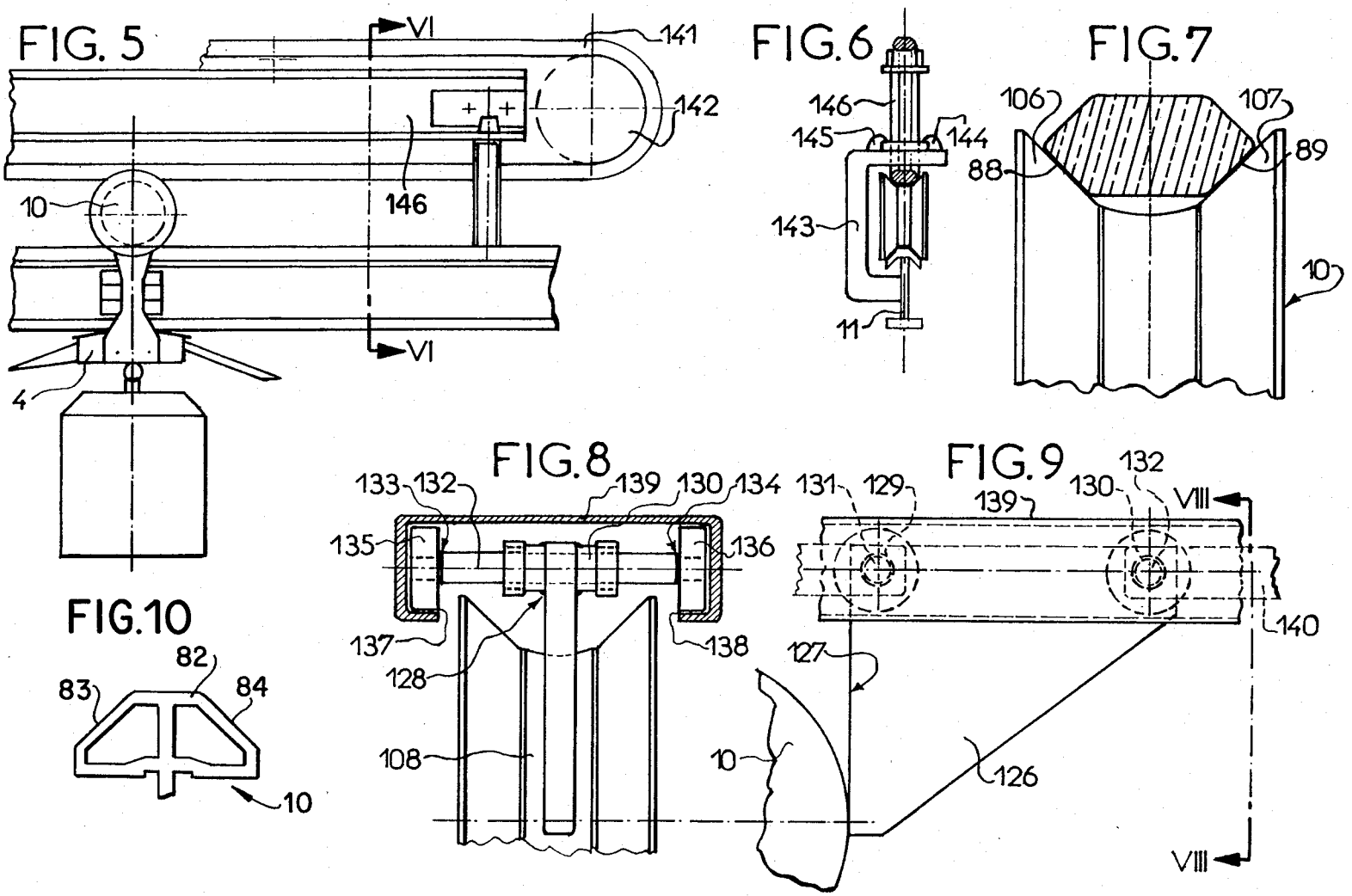
FIG. 5 is an overhead view of an auxilary drive component for a bogie, according to one application of the invention.
FIG. 6 is a sectional view according to the line identified as VI—VI in FIG. 5.
FIG. 7 is a partial view of a wheel in contact with the auxiliary drive mechanism.
FIG. 8 is a sectional view according to the line identified as VIII—VIII.
FIG. 9 is an overhead view of the auxiliary drive components of a bogie, according to another application of the invention.
FIG. 10 is a fragmentary, sectional view, on an enlarged scale, taken along line X—X in FIG. 1.

In relation to FIGS. 8 and 9, the push-rod (126), whose front portion (127) engages with the center disc (108) for the wheel (10), possesses an upper section (128) containing two hubs (129,130), with axles (131,132) extending through these hubs. The ends (133,134) of the aforementioned axles (131,132) contain rollers (135,136) which can move along the roller-tracks (137,138) on a rail (139) with a horizontal "C" section. The push-rod or push-rods (126) can be operated by means of a chain (140).

In relation to FIGS. 5 and 7, it is possible to cite another application wherein the auxiliary drive component engages with the side-plates (106,107), instead of the center disc (108). In accordance with this version of the invention, the auxiliary drive component is an endless belt (141) which is powered by a rotary drum (142). The aforementioned endless belt (141) engages with the convex sides (88,89) of the side-plates (106,107) for the wheel (10).

As can be observed in FIGS. 5 and 6, the angle bar (11) is joined to braces (143) which are fastened to a metal framework (146) by means of claws (144,145).

Although the present invention has been described in relation to a specific application thereof, it is obvious that the invention is not in any way restricted to this applications, and that it is possible to introduce various modifications with respect to shapes, materials, and combinations of components, without thereby departing from the context and essence of said invention.

I claim:

1. A system for transporting loads, the system being of the type including a series of guide rails with horizontal sections and sloping sections, wherein each guide rail has a support portion and at least one track portion situated above it, and vehicle means supported by and guided along said rails for carrying the loads characterized in that:

the guide rail has an upper tubular angle bar, a perfectly gauged lower flat angle bar situated below, and an upright center web connecting the upper and lower bars, the guide rail being composed of an extruded material, the center web having fasteners and catches on a surface thereof;

insulating angle bars secured by said fasteners and catches and outfitted with electric power lines;

vertically turning guide wheels on the vehicle means;

the lower angle bar being demarcated by two parallel, vertical edges constituting tracks for the rollers, the lower angle bar having an upper surface with two lengthwise grooves therein, the upper surface having parallel shoulders projecting upwardly, each of said grooves being situated between two parallel shoulders, and which function as stops for the top portions of means of attachment, means of attachment adapted to be inserted along predefined axes, and at least one further groove in said top surface, adjacent one of said shoulders a fish-plate mounted in contact with said center web and having a longitudinal edge dimensioned to fit in said further groove, and the lower angle bar having a lower surface containing incisions, with said incisions being situated within the same vertical plane as the axes along which means of attachment are inserted.

2. A system for transporting loads in accordance with claim 1, characterized in that the upper tubular angle bar has an undersurface with a groove situated within the same vertical plane as each further groove located upon the upper surface of the lower flat angle bar, said upper angle bar groove constitutes a housing for an additional fish-plate, the fish-plates possessing longitudinally slanting, abutting edges to permit relative sliding movement of the edges for adjustment of vertically directed pressure applied by the fish-plates within their respective grooves, and horizontal openings for insertion of means of attachment which connect the aforementioned fish-plates to the angle bar.

3. A system for transporting loads, the system being of the type including a series of guide rails with horizontal sections and sloping sections, wherein each guide rail has a support portion and at least one track portion situated above it, and vehicle means supported by and guided along said rails for carrying the loads, COMPRISING:

the guide rail having an upper tubular angle bar, a perfectly gauged lower flat angle bar situated below and an upright center web connecting the upper and lower bars, the guide rail being composed of an extruded material, the center web having fasteners and catches on a surface thereof;

insulating angle bars secured by said fasteners and catches and outfitted with electric power lines; said catches comprising L-shaped numbers a horizontal side in contact with said surface and a vertical side having edges with tilting portions facing away from said web in order to facilitate attachment of structures which contain said electric power lines, the horizontal side having an outer surface disposed to function as a stop for one of said fasteners.

4. A system for transporting loads in accordance with claim 3, characterized in that said power line contains structures including an angle bar composed of insulating materials outfitted with two claws having unattached ends with bent portions which engage with the inner surfaces of the vertical sides of the catches, and in that there are two housings and a pair of two-pole electric power lines mounted therein, said claws having outer surfaces with dovetailed grooves situated thereon, and biconical struts inserted in said dovetailed grooves in order to secure portions of the electric power lines.

5. A system for transporting loads in accordance with claim 4, characterized in that the angle bar composed of insulating materials, the electric power lines, and the biconical struts are mounted so as to be capable of shifting in relation to one another so as to retain their own respective expansivity.

6. A system for transporting loads, the system being of the type including a series of guide rails with flat sections and inclined sections, wherein each guide rail has a support portion and at least one track portion situated above it, and vehicle means supported by and guided along said rails for carrying the loads, the vehicle means including at least one wheel having a radially directed, circumferential groove shaped to fit over said track portion, the groove having a radially innermost portion and side walls which flare radially outwardly from said portion, the track having side walls which flare radially outwardly and are in spaced, opposed relationship to said groove side walls, the crossectional shape of the wheel groove and the track over which it fits being such that the uppermost portion of the track contacts the radially innermost portion of the wheel groove, but the respective opposed side walls are not in engagement, said track having its uppermost portion truncated over an inclined section thereof, said opposed side walls coming into contact by means of a corner configuration when the vehicle traverses said inclined section, to increase the frictional engagement between said wheel and said track over said inclined section.

7. A system for transporting loads, the system being of the type including a series of guide rails with horizontal sections and sloping sections, wherein each guide rail has a support portion and at least one track portion situated above it, and vehicle means supported by and guided along said rails for carrying the loads, the vehicle means including at least one wheel having a radially directed, circumferential groove shaped to fit over said track portion, the crossectional shape of the wheel groove and the track over which it fits being such that the uppermost portion of the track contacts the radially innermost portion of the wheel groove, said system comprising:

a power-reduction assembly including a shaft upon which said wheel is mounted;

said wheel including opposed side-plates mounted for rotation on said shaft and a center disc mounted on said shaft between said side-plates and having a diameter less than that of said side-plates so as to form said groove, said side-plates being shaped to taper in diameter towards said center disc; and a release mechanism permitting separate rotation of the center disc in relation to the side-plates and in relation to the shaft for the power-reduction assembly.

8. A system for transporting loads in accordance with claim 7, characterized in that said release mechanism includes a housing with an inner wall facing away from said center disc situated in each of the side-plates, the shaft end extending through said inner walls and into said housings, a brake disc situated against each inner wall and concentrically mounted on the shaft in each of the housings, a sleeve mounted on the shaft between each brake disc and the center disc, mounted on each sleeve, each corresponding brake disc, sleeve and ball bearing being situated within a respective side-plate, a hub slideably mounted on said shaft and positioned against one of said brake discs the other brake disc being retained against axial movement with respect to said shaft, and means for pressing said hub against said one brake disc.

9. A system for transporting loads in accordance with claim 8 wherein said pressing means includes resilient means for applying an axial force between the sliding hub and said shaft so as to force together the two side-plates and to press them tightly against the center disc, in order for these three components to form a single unit.

10. A system for transporting loads in accordance with claim 7, characterized in that, for atmospheres containing explosive substances, it includes auxiliary drive components for the vehicle when the wheels are in a disengaged position.

11. A system for transporting loads in accordance with claim 10, characterized in that the aforementioned auxiliary drive components comprise a push-rod having a front portion which engages with the center disc of the wheel, an axle, hubs situated upon the axle having ends, rollers on said ends, a rail having roller-tracks with a horizontal "C" shape which receive said rollers and means including a chain for moving said push rod.

12. A system for transporting loads in accordance with claim 10, characterized in that the auxiliary drive component includes an endless belt, and a rotary drum for powering the belt, which drum engages with the sides of the side-plates of the wheel in a disengaged position.

* * * * *